US010135166B2

(12) United States Patent
Tian et al.

(10) Patent No.: US 10,135,166 B2
(45) Date of Patent: Nov. 20, 2018

(54) SYMMETRIC DUAL BEAM CONTACT

(71) Applicant: FOXCONN INTERCONNECT TECHNOLOGY LIMITED, Grand Cayman (KY)

(72) Inventors: Xiao-Xian Tian, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/688,742

(22) Filed: Aug. 28, 2017

(65) Prior Publication Data

US 2018/0062295 A1 Mar. 1, 2018

(30) Foreign Application Priority Data

Aug. 29, 2016 (CN) ..... 2016 1 0743326

(51) Int. Cl.

| | |
|---|---|
| ***H01R 13/11*** | (2006.01) |
| ***H01R 4/02*** | (2006.01) |
| ***H01R 12/71*** | (2011.01) |
| ***H01R 12/73*** | (2011.01) |
| ***H01R 13/24*** | (2006.01) |
| ***H01R 13/28*** | (2006.01) |
| ***H01R 24/60*** | (2011.01) |
| *H01R 12/58* | (2011.01) |
| *H01R 12/70* | (2011.01) |
| *H01R 13/41* | (2006.01) |

(52) U.S. Cl.

CPC ..... *H01R 13/11* (2013.01); *H01R 4/02* (2013.01); *H01R 12/716* (2013.01); *H01R 12/737* (2013.01); *H01R 13/112* (2013.01); *H01R 13/2492* (2013.01); *H01R 13/28* (2013.01); *H01R 24/60* (2013.01); *H01R 12/58* (2013.01); *H01R 12/707* (2013.01); *H01R 13/41* (2013.01)

(58) Field of Classification Search

CPC ..... H01R 13/11; H01R 13/14; H01R 13/112; H01R 4/02; H01R 12/58

USPC ..... 439/290

See application file for complete search history.

(56) References Cited

U.S. PATENT DOCUMENTS 6,382,989 B1 * 5/2002 Yu ..... H01R 13/4361 439/686

7,261,589 B2 * 8/2007 Gillespie ..... H01R 12/774 439/260

(Continued)

FOREIGN PATENT DOCUMENTS

CN 204179288 U 2/2015

CN 105449421 A 3/2016

*Primary Examiner* — Harshad C Patel

(74) *Attorney, Agent, or Firm* — Wei Te Chung; Ming Chieh Chang

(57) ABSTRACT

An electrical connector includes an insulative housing, a plurality of terminals retained in the housing. The housing includes a base and a mating tongue extending forwardly from the base. The mating tongue forms opposite mating surfaces forwardly extending and vertically converging toward each other. The terminal includes a main body, a pair of beams extending forwardly from a front side of the main body for being respectively exposed upon the opposite mating surfaces, and a pair of soldering sections extending outwardly and laterally for mounting to a printed circuit board.

20 Claims, 3 Drawing Sheets

(56) References Cited

U.S. PATENT DOCUMENTS

| | | | | |
|---|---|---|---|---|
| 7,393,240 | B2 * | 7/2008 | Nishimatsu | H01R 12/88 439/495 |
| 7,442,057 | B2 * | 10/2008 | Ko | H01R 12/716 439/101 |
| 7,491,088 | B2 * | 2/2009 | Suzuki | H01R 12/592 439/607.01 |
| 7,534,131 | B2 * | 5/2009 | Chung | H01R 12/7094 439/495 |
| 7,727,006 | B1 * | 6/2010 | Huang | H01R 12/88 439/495 |
| 2004/0180572 | A1 * | 9/2004 | Chiu | H01R 12/79 439/495 |
| 2004/0242071 | A1 * | 12/2004 | Ito | H01R 13/6585 439/108 |
| 2016/0134055 | A1 * | 5/2016 | Chen | H01R 13/642 439/217 |

* cited by examiner

SYMMETRIC DUAL BEAM CONTACT

BACKGROUND OF THE DISCLOSURE

1. Field of the Disclosure

The invention is an electrical connector, and particularly to the electrical connector having the dual beam contact having opposite outward contacting edges exposed upon opposite mating surfaces of the mating tongue.

2. Description of Related Arts

China CN204179288U discloses the receptacle connector having an insulative housing with a plurality of terminals therein wherein each terminal includes two beams respectively exposed upon two opposite mating surfaces of the mating tongue of the housing. Anyhow, the two opposite mating surfaces extend parallel to each other and the dual beams are required to be tightly sandwich a horizontal bar in a passageway for avoiding inadvertent split, thus lacking resiliency and reliability thereof disadvantageously.

A dual-beam contact for use with an electrical connector with the reliable retention and resiliency is desired.

SUMMARY OF THE DISCLOSURE

To achieve the above desire, an electrical connector includes an insulative housing, a plurality of terminals retained in the housing. The housing includes a base and a mating tongue extending forwardly from the base. The mating tongue forms opposite mating surfaces extending forwardly and vertically converging toward each other. The terminal includes a main body, a pair of beams extending forwardly from a front side of the main body for being respectively exposed upon the opposite mating surfaces, and a pair of soldering sections extending outwardly and laterally for mounting to a printed circuit board.

DETAILED DESCRIPTION OF THE PREFERRED EMBODIMENT

Figure 1:
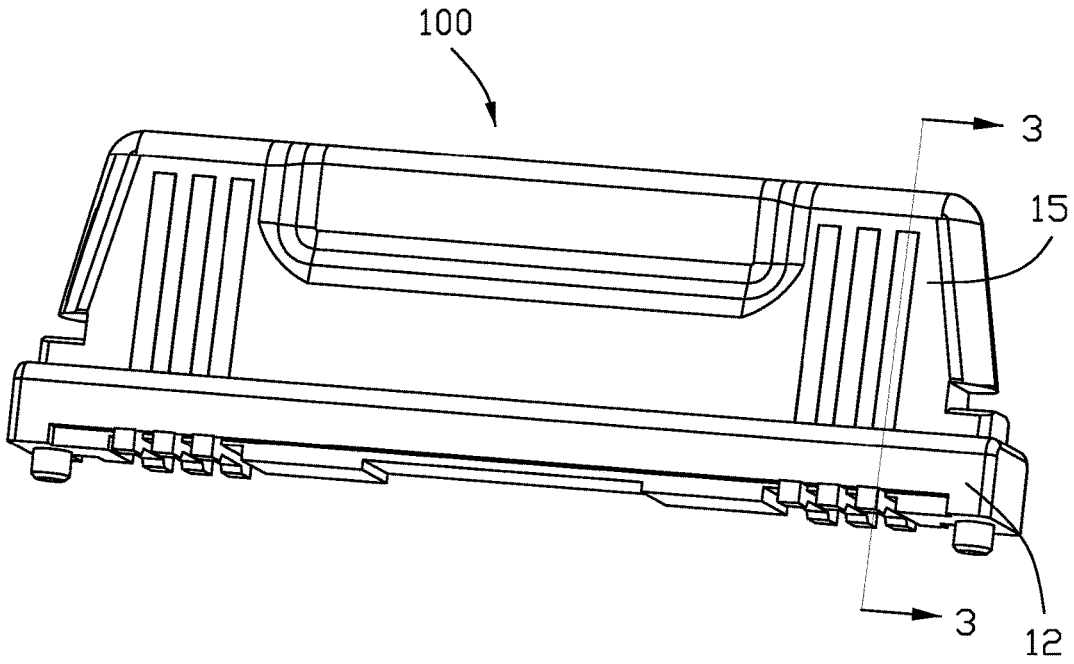
FIG. 1 is a perspective view of an electrical connector of the invention according to the presently preferred embodiment.
Figure 2:
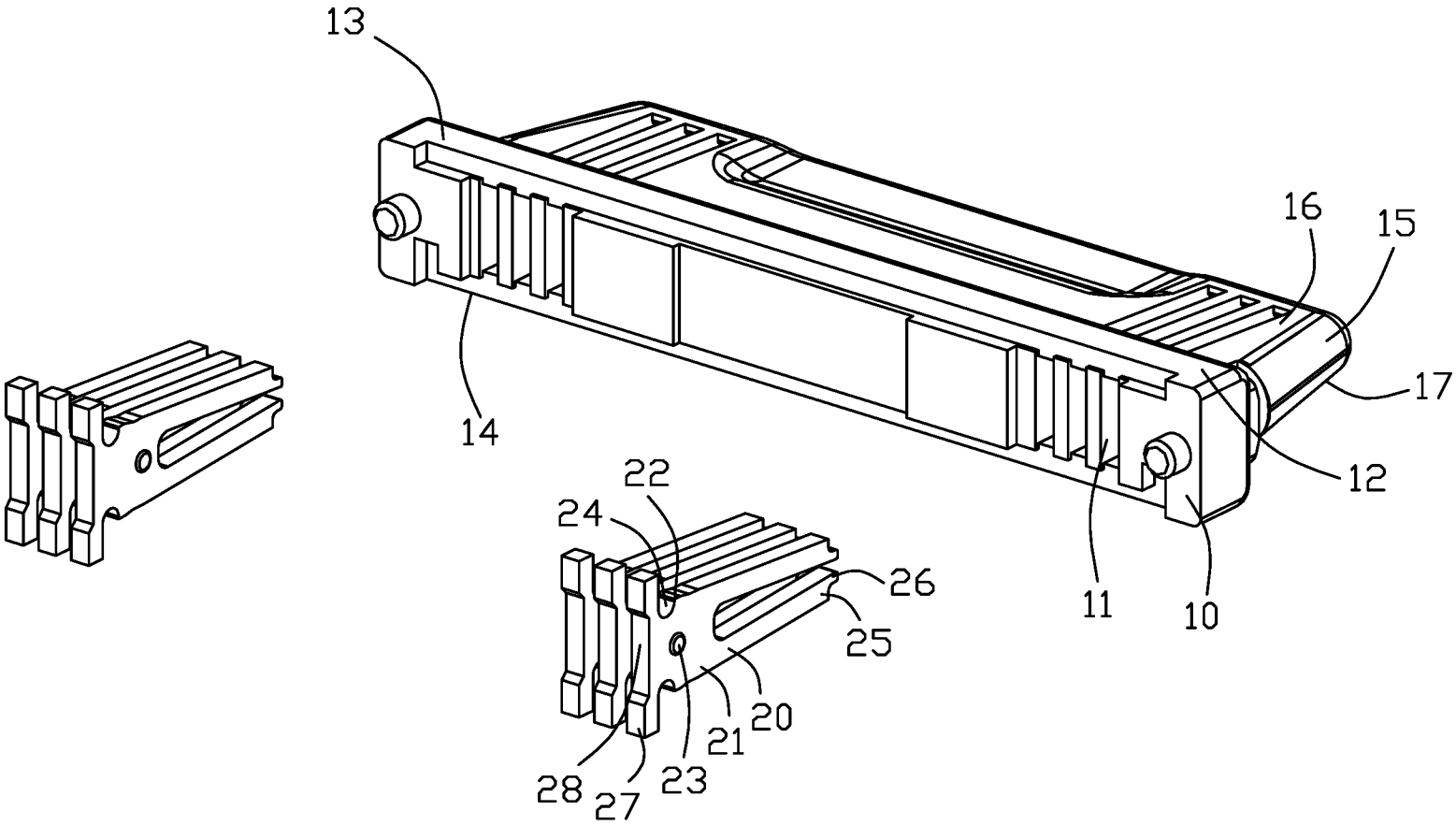
FIG. 2 is an exploded perspective view of the electrical connector of FIG. 1.
Figure 3:
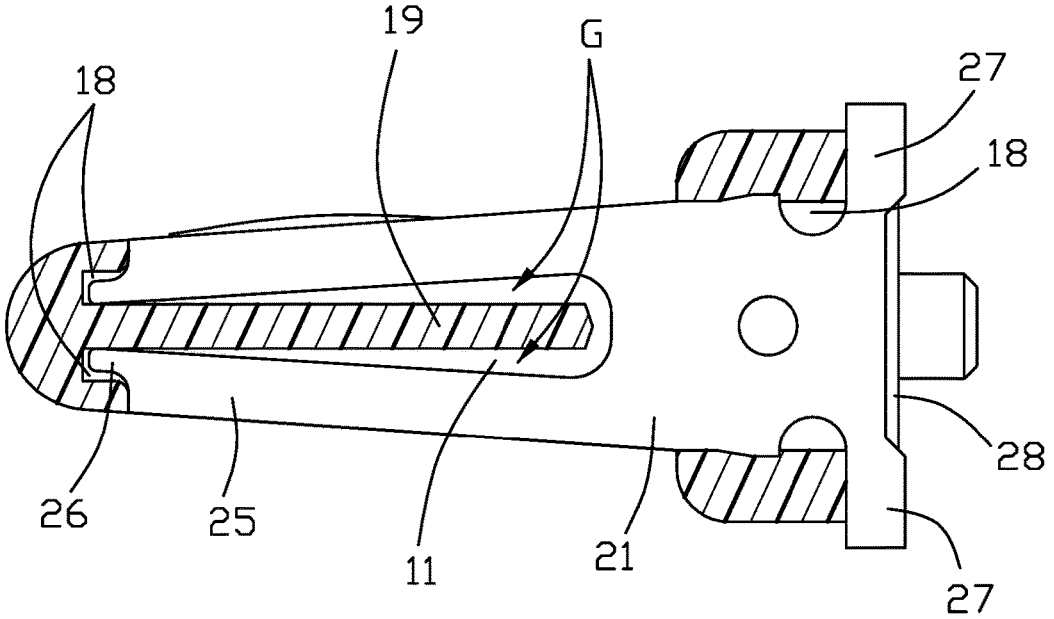
FIG. 3 is a cross-sectional view of the electrical connector of FIG. 1.

Referring to FIGS. 1-3, an electrical connector 100 for mounting to a printed circuit board (not shown), includes an insulative housing 10 and a plurality of terminals 20 retained in the housing 10. The housing 10 includes a plurality of passageways 11 open to an exterior not only rearwardly so as to allow the terminals 20 to be inserted thereinto from a rear side of the housing 10 but also vertically so as to expose the terminals. The hosing 10 includes a base 12 and a mating tongue 15 forwardly extending from the base 12. The base 12 includes opposite upper face 13 and lower face 14. The mating tongue 15 includes opposite first/upper mating surface 16 and second/lower mating surface 17. The terminal 12 is made by stamping from sheet metal and essentially perpendicular to the first/second mating surfaces 16/17.

The terminal 20 includes a main body 21, a pair of contacting beams 25 extending forwardly from the front side of the main body 21 in the front-to-back direction and spaced from each other in the vertical direction, and a pair of soldering sections 27 extending outwardly and laterally from the rear side of the main body 21 in the vertical direction. The pair of beams 25 are exposed upon the opposite first/second mating surfaces 15/16 in a coplanar manner. The main body 21 includes barbs 22 on two opposite side edges to interfere with the housing 10 in the vertical direction perpendicular to the front-to-back direction. The main body 21 further includes a dimple 23 to interfere with the housing 10 in the transverse direction perpendicular to both the front-to-back direction and the vertical direction. The contacting beams 25 forwardly converge to each other. A distal free end of each contacting beam 25 forms an engagement tab 26 protectively embedded within the recessed region 18 located at the front end region of the corresponding passageway 11 in the mating tongue 15 for preventing the corresponding contacting beam 25 from moving outwardly in the vertical direction. The soldering section 27 are exposed on two opposite sides of the base 12 with regard to the front-to-back direction in a symmetrical manner so as to provide the stable support to the whole connector 100. A recess 28 is formed between the pair of soldering sections 27 for accommodating the excessive soldering material, if any.

In this embodiment, a divider 19 is formed in each passageway 11 and sandwiched by the pair of contacting beams 25 in the vertical direction with gap G therebetween for providing resiliency of each contacting beam 25. Notably, the gap G may be omitted in other embodiments. In this embodiment, the pair of contacting beams 25 extend forwardly and converge toward each other in the vertical direction with only the engagement sections 26 sandwiching the divider 29. Understandably, if the gap G is completely omitted between the pair of contacting beams 25 and the divider 19, during assembling the terminal 20 into the passageway 11, the insertion force may be improperly significantly large due to friction between the whole length of each contacting beam 25 and the divider 19. Notably, in this embodiment each passageway 11 includes a pair of recessed regions 18 by two sides of the divider 19 around the root of the divider 19 for receiving the corresponding engagement tabs 26.

In this embodiment, even though along the front-to-back direction, the mating tongue 15 has a larger rear dimension/thickness and smaller front dimension/thickness in the vertical direction so as to have the corresponding first mating surface 15 and the second mating surface 16 extend toward each other in the vertical direction in a converged/tapered manner, along the front-to-back direction each contacting beam 25 still keeps the constant dimension/width in the vertical direction so as to form the corresponding gap G between the divider 19 and the contacting beams 25.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base and a mating tongue extend forwardly from the base in a front-to-back direction, said mating tongue forming opposite first and second mating surfaces extending forwardly in the front-to-back direction, and converging to each other in a vertical direction perpendicular to the front-to-back direction;

a plurality of passageways formed in the housing and open to an exterior not only rearwardly in the front-to-back direction but also upwardly and downwardly in the vertical direction, a horizontally extending divider formed in each of said passageways; and a plurality of terminals disposed in the corresponding passageways, respectively, each of said terminals including a main body, a pair of contacting beams forwardly extending from a front side of the main body and spaced from each other in the vertical direction; wherein the divider is sandwiched between said pair of contacting beams of the corresponding terminal with corresponding gaps therebetween in the vertical direction except that an engagement tab located at a front end of each of the contacting beams intimately abuts against the divider in the vertical direction.

2. The electrical connector as claimed in claim 1, wherein each of the passageways further includes a pair of recessed regions at a front end thereof by two sides of the divider around a root of the divider to receive the pair of engagement tabs of the corresponding terminal thereby preventing the corresponding contacting beams from outwardly moving in the vertical direction.

3. The electrical connector as claimed in claim 1, wherein each of said terminal further includes a pair of soldering sections extending from a rear side of the main body on two sides vertically and laterally.

4. The electrical connector as claimed in claim 1, wherein the pair of contacting beams are respectively exposed upon the opposite first and second mating surfaces in a coplanar manner.

5. The electrical connector as claimed in claim 4, wherein in each terminal, the pair of contacting beams converge toward each other in the vertical direction with said gaps with regard to the divider except at the engagement tabs.

6. The electrical connector as claimed in claim 5, wherein in each terminal, each contacting beam has a constant width in the vertical direction so as to form said gap with regard to the divider except at the engagement tab.

7. The electrical connector as claimed in claim 6, wherein the main body forms barbs or a dimple for retaining to the housing.

8. The electrical connector as claimed in claim 6, wherein the first mating surface and the second mating surface face away from each other.

9. An electrical connector comprising:

an insulative housing including a base and a mating tongue extend forwardly from the base in a front-to-back direction, said mating tongue forming opposite first and second mating surfaces extending forwardly in the front-to-back direction, and converging to each other in a vertical direction perpendicular to the front-to-back direction;

a plurality of passageways formed in the housing and open to an exterior not only rearwardly in the front-to-back direction but also upwardly and downwardly in the vertical direction, a horizontally extending divider formed in each of said passageways; and a plurality of terminals disposed in the corresponding passageways, respectively, each of said terminals including a main body, a pair of contacting beams forwardly extending from a front side of the main body and spaced from each other in the vertical direction, each of said contacting beams forming an engagement tab at a front end; wherein the divider is located between said pair of contacting beams of the corresponding terminal; wherein each of the passageways further includes a pair of recessed regions at a front end thereof by two sides of the divider and intimately adjacent to a root of the divider to receive the pair of engagement tabs of the corresponding terminal thereby preventing the corresponding contacting beams from outwardly moving in the vertical direction.

10. The electrical connector as claimed in claim 9, wherein each of said terminal further includes a pair of soldering sections extending from a rear side of the main body on two sides vertically and laterally.

11. The electrical connector as claimed in claim 9, wherein the opposite first and second mating surfaces face away from each other.

12. The electrical connector as claimed in claim 11, wherein in each terminal, the pair of contacting beams converge toward each other in the vertical direction with gaps with regard to the divider except at the engagement tabs.

13. The electrical connector as claimed in claim 12, wherein in each terminal, each contacting beam has a constant width in the vertical direction so as to form said gap with regard to the divider except at the engagement tab.

14. An electrical connector comprising:

an insulative housing including a base and a mating tongue extend forwardly from the base in a front-to-back direction, said mating tongue forming opposite first and second mating surfaces extending forwardly in the front-to-back direction, and converging to each other in a vertical direction perpendicular to the front-to-back direction;

a plurality of passageways formed in the housing and open to an exterior not only rearwardly in the front-to-back direction but also upwardly and downwardly in the vertical direction, a horizontally extending divider formed in each of said passageways; and a plurality of terminals disposed in the corresponding passageways, respectively, each of said terminals including a main body, a pair of contacting beams forwardly extending from a front side of the main body and spaced from each other in the vertical direction; wherein the divider is located between said pair of contacting beams of the corresponding terminal; wherein the pair of contacting beams are respectively exposed upon the opposite first and second mating surfaces in a coplanar manner; wherein in each terminal, the pair of contacting beams converge toward each other in the vertical direction.

15. The electrical connector as claimed in claim 14, wherein in each terminal, each contacting beam has a constant width in the vertical direction.

16. The electrical connector as claimed in claim 15, wherein the pair of contacting beams and the corresponding divider therebetween commonly form gaps.

17. The electrical connector as claimed in claim 16, wherein each of said pair contacting beams forms an engagement tab at a front end abutting against the divider in the vertical direction around a root of the divider.

18. The electrical connector as claimed in claim 17, wherein a pair of recessed regions are formed in a front end of each of said passageways around a root of the corresponding divider to receive the corresponding engagement tab.

19. The electrical connector as claimed in claim 14, wherein each of said terminal further includes a pair of soldering sections extending from a rear side of the main body on two sides vertically and laterally.

20. The electrical connector as claimed in claim 14, wherein the first mating surface and the second mating surface face away from each other.

* * * * *